US006257372B1

(12) United States Patent
Schirmer

(10) Patent No.: US 6,257,372 B1
(45) Date of Patent: Jul. 10, 2001

(54) SCISSOR LIFT AND METHOD FOR USING THE SAME

(75) Inventor: Michael Schirmer, Orono (CA)

(73) Assignee: Kelley Company, Inc., Mequon, WI (US)

( * ) Notice: Subject to any disclaimer, the term of this patent is extended or adjusted under 35 U.S.C. 154(b) by 0 days.

(21) Appl. No.: 09/404,123

(22) Filed: Sep. 23, 1999

Related U.S. Application Data

(60) Provisional application No. 60/144,003, filed on Jul. 15, 1999.

(51) Int. Cl.[7] ..... B66B 9/02

(52) U.S. Cl. ..... 187/269; 254/122

(58) Field of Search ..... 187/211, 269, 187/242; 254/89 R, 122; 182/141, 148, 63

(56) References Cited

U.S. PATENT DOCUMENTS 3,174,722 * 3/1965 Alm ..... 187/269
4,995,130 2/1991 Hahn et al. ..... 14/71.3
5,111,546 5/1992 Hahn et al. ..... 14/71.3

* cited by examiner

*Primary Examiner*—Kenneth W. Noland
(74) *Attorney, Agent, or Firm*—Michael Best & Friedrich LLP

(57) ABSTRACT

A scissor lift that achieves enhanced vertical travel of the deck for a given amount of horizontal travel of the legs. The enhanced vertical travel is achieved by overlapping the deck pivot point (i.e., the point at which a leg is pivotally connected to the deck) with the frame pivot point (i.e., the point at which a leg is pivotally connected to the frame) when the deck is in the fully lowered position. That is, the deck pivot point is lower than the frame pivot point when the deck is fully lowered. The pivot points can occur on the same leg or on different legs. The deck and frame pivot points can provide purely pivotal movement or a combination of pivotal and some other type of movement (e.g., translational movement). The above-described scissor lifts can be utilized to perform corresponding methods of lowering a scissor lift. In the method, the deck pivot is positioned lower than the frame pivot when the deck is in the fully lowered position.

15 Claims, 6 Drawing Sheets

SCISSOR LIFT AND METHOD FOR USING THE SAME

This application claim benefit to U.S. provisional application No. 60/144,003 Jul. 15, 1999.

FIELD OF THE INVENTION

This invention relates generally to lifts and more particularly, to scissor lifts having pivotal legs for raising and lowering lift decks.

BACKGROUND OF THE INVENTION

The design of scissor lifts and lifts operating under similar principles via rotating legs is inherently limited by two primary design considerations: the desire for a large vertical travel and the need for lift stability. These two design considerations are generally at odds with respect to one another because increased lift height typically results in decreased lift stability. In conventional scissor lifts such as the scissor lift illustrated in FIGS. 1–3, movement of the scissor lift legs causes a change in elevation of the scissor lift deck. In particular, the legs 2, 3 of the scissor lift 1 are pivotally connected to the scissor lift frame 4 below and to the scissor lift deck 5 above, as shown. When the legs 2, 3 are pivoted in one direction, the legs 2, 3 push the deck 5 up to an elevated position shown in FIG. 3, and when the legs 2, 3 are pivoted in an opposite direction, the deck 5 descends to a lowered position shown in FIG. 2. The vertical movement of the deck 5 is directly dependent upon the horizontal distance traveled by the legs 2, 3 in their movement. As such, a conventional scissor lift design having increased horizontal leg travel generally has a greater lift range.

As noted above, however, larger lift ranges typically result in decreased lift stability for a given platform length (particularly when the lifts are in their elevated positions). The horizontal distance through which the legs 2, 3 can pass is therefore limited to a range as shown in FIGS. 2 and 3. However, even if the lift 1 is stable at its upper lift range, other factors impact the lift design and the operation and connection of the legs 2. For example, the deck 5 should be adequately supported by the legs 2, 3 in every elevational position of the lift 1. Inadequate support can cause deck deflection, bending, and undesirable stresses in the deck and lift 1. As another example, the legs 2, 3 should be smoothly and easily retractable to a position such as that shown in FIG. 2 in which the legs 2, 3 are folded and the deck 5 is lowered to a preferably compact position. The legs 2, 3 should also be smoothly and easily extendable to a fully extended position such as that shown in FIG. 3. The placement and relationship of the legs 2, 3 with respect to one another is necessarily restricted by the positions of the legs 2, 3 in their fully extended and fully retracted positions and their need to move freely through their range of motion without mutual interference. As illustrated in FIGS. 1–3, even the shape of the legs 2, 3 is often selected so that the legs 2, 3 can perform the above-described functions (e.g., to nest properly when the lift 1 is placed in its lowered position shown in FIG. 2).

Although conventional scissor lift designs adequately address the above-described design considerations, such designs are typically inefficient. Conventional scissor lifts often are unnecessarily complex, expensive to manufacture, and/or have a lift range which is less than optimal.

In light of the problems and limitations of the prior art described above, a need exists for a scissor lift apparatus and method which more efficiently utilizes movement of scissor lift legs to produce deck lift and which provides for a stable scissor lift, a fully supported scissor lift deck throughout the range of lift positions, and an easy to manufacture scissor lift having a relatively simple design. Each preferred embodiment of the present invention achieves one or more of these results.

SUMMARY OF THE INVENTION

The present invention provides a scissor lift that achieves enhanced vertical travel of the deck for a given amount of horizontal travel of the legs. The present invention achieves this result by overlapping the deck pivot point (i.e., the point at which a leg is pivotally connected to the deck) with the frame pivot point (i.e., the point at which a leg is pivotally connected to the frame) when the deck is in the fully lowered position. That is, the deck pivot point is lower than the frame pivot point when the deck is fully lowered. The pivot points can occur on the same leg or on different legs, thus providing the two different aspects of the invention described below.

In one aspect, the invention is embodied in a scissor lift comprising a frame, a deck movable relative to the frame between a fully elevated position and a fully lowered position, and a leg coupled to the frame for pivotal movement about a first pivot point and coupled to the deck for pivotal movement about a second pivot point. The leg is rotatable between a first position in which the first pivot point is higher than the second pivot point and a second position in which the first pivot point is lower than the second pivot point. The first position corresponds with the fully lowered position of the deck and the second position corresponds with the fully elevated position of the deck. By overlapping the pivot points as described above, the vertical travel of the deck in increased.

The leg can be coupled to the frame for purely pivotal movement about the first pivot point, and can be coupled to the deck for pivotal and translational movement. In this embodiment, the second pivot point translates relative to the deck. For example, a translation element such as a roller can be used to couple the leg to the deck. Alternatively, the leg could be coupled to the deck for purely pivotal movement about the first pivot point, and could be coupled to the frame for pivotal and translational movement. In this embodiment, the second pivot point translates relative to the frame. If desired, two or more legs could be used in the above-described manner.

In another aspect, the benefits of the present invention are achieved by providing a scissor lift comprising a frame, a deck movable relative to the frame between a fully elevated position and a fully lowered position, a first leg coupled to the frame for pivotal movement about a first pivot point, and a second leg coupled to the deck for pivotal movement about a second pivot point. The first and second legs are pivotable between a first position in which the first pivot point is higher than the second pivot point and a second position in which the first pivot point is lower than the second pivot point. The first leg can be coupled to the frame for pivotal and translational movement and the second leg can be coupled to the deck for pivotal and translational movement. Alternatively, the first leg can be coupled to the deck for purely pivotal movement, and the second leg can be coupled to the frame for purely pivotal movement.

The above-described overlapping of the pivot points can be achieved in a number of ways. For example, the deck pivot point can be spaced from the deck surface, and the frame pivot point can be spaced from the base of the frame. When both pivotal and translational movement is utilized, a deck rail can be spaced from the deck surface to provide a surface upon which a translation element (e.g., a roller) can be positioned, and a frame rail can be spaced from the base of the frame to provide a surface upon which a translation element (e.g., a roller) can be positioned.

The above-described scissor lifts can be utilized to perform corresponding methods of lowering a scissor lift. In one aspect, the method includes the steps of pivoting a leg relative to the frame about a first pivot point and relative to the deck about a second pivot point that is higher than the first pivot point, thereby causing the deck to be lowered, and lowering the second pivot point until the second pivot point is lower than the first pivot point. The pivoting steps can be purely pivotal movement or a combination of pivotal and some other type of movement (e.g., translational movement).

In another aspect, the method includes the steps of pivoting a first leg relative to the frame about a first pivot point, pivoting a second leg relative to the deck about a second pivot point that is higher than the first pivot point, and lowering the second pivot point until the second pivot point is lower than the first pivot point. As with the first method described above, the pivoting steps can be purely pivotal movement or a combination of pivotal and some other type of movement (e.g., translational movement).

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 4:
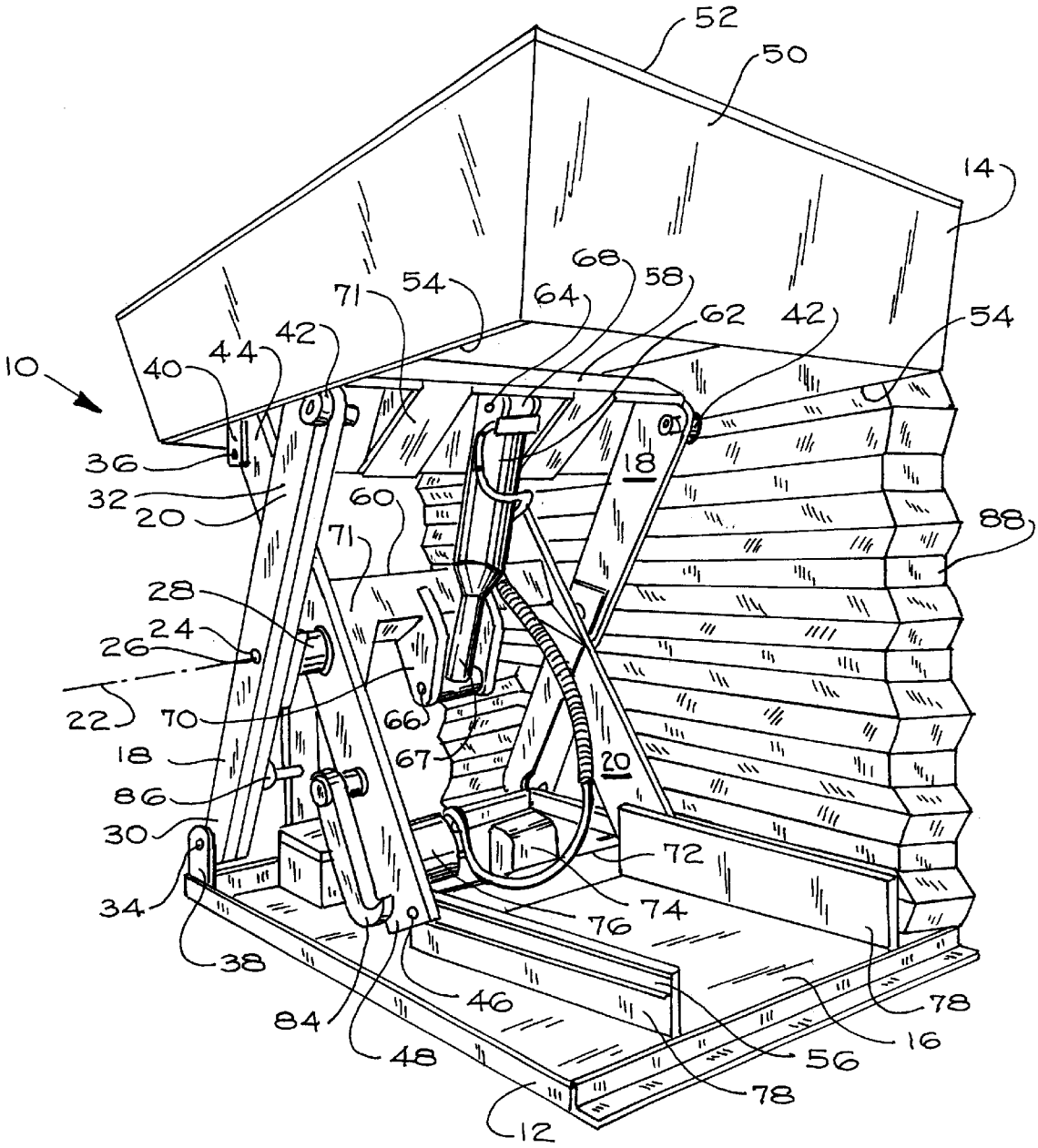
FIG. 4 is a perspective view of a scissor lift according to a preferred embodiment of the present invention, showing the scissor lift in its fully elevated position.
Figure 5:
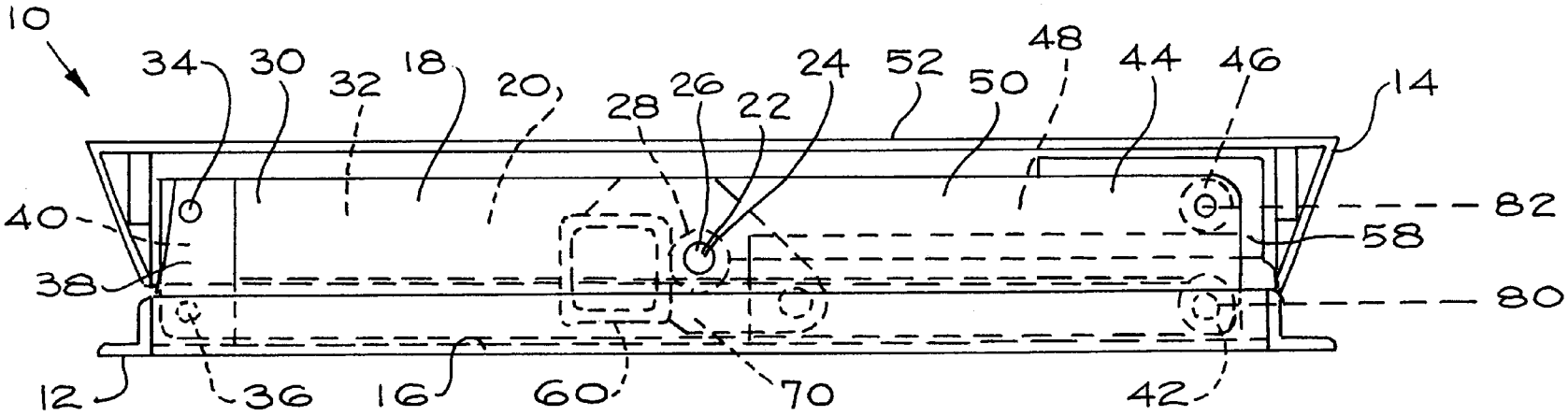
FIG. 5 is a side elevational view of the scissor lift shown in FIG. 4, with the scissor lift in its fully lowered position.
Figure 6:
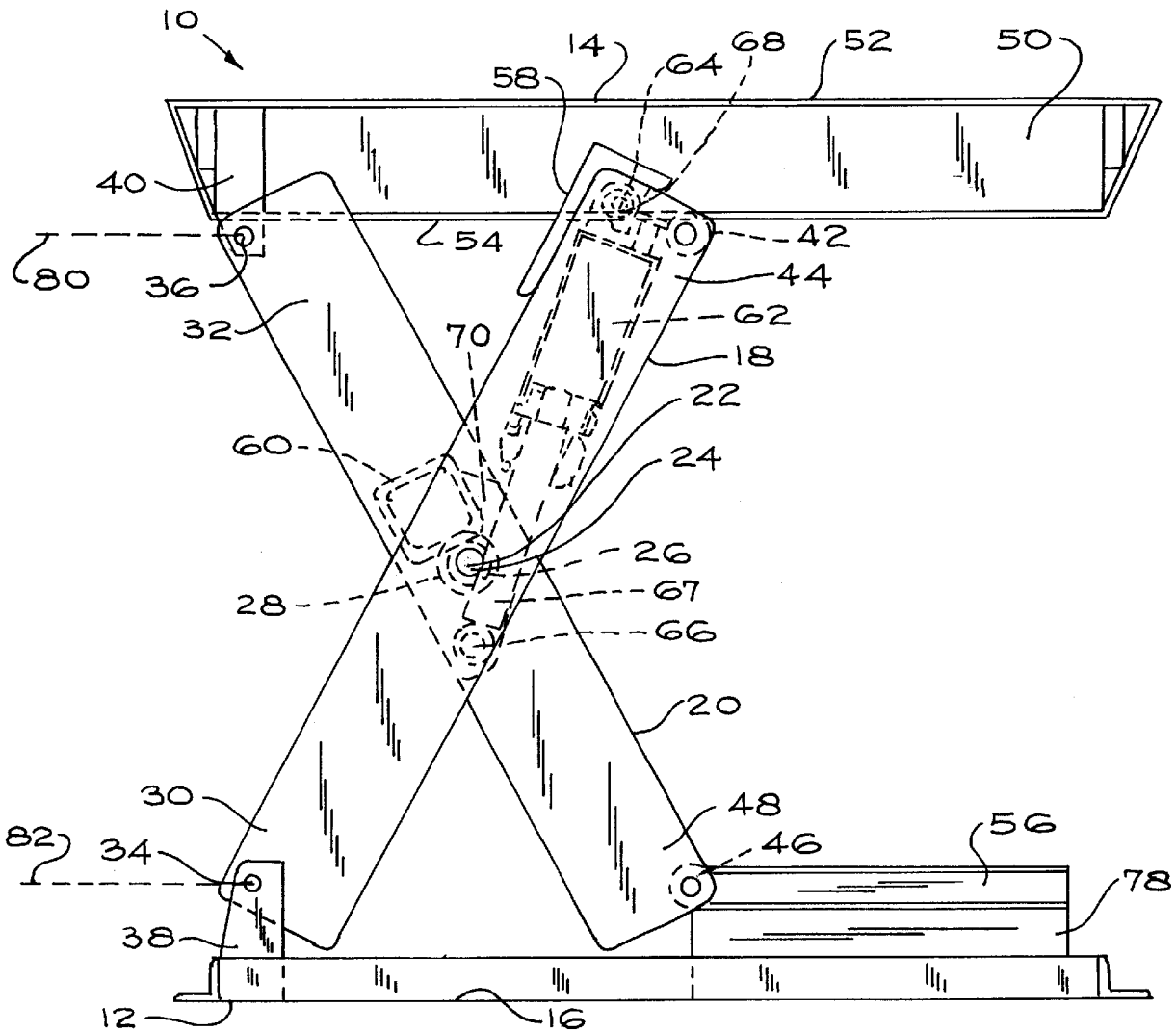
FIG. 6 is a side elevational view of the scissor lift shown in FIGS. 4 and 5, with the scissor lift in its fully elevated position.

The scissor lift of the present invention is indicated generally at 10 in FIGS. 4–6, and has a frame 12, a deck 14, and legs 18, 20 for supporting the deck 14 in at least two positions above the frame 12. The frame 12 preferably has a base 16 (e.g., a base plate, or the like) upon which frame elements and other components of the frame 12 are mounted. Preferably, the lift 10 has four legs 18, 20 as best seen in FIG. 4: a pair of crossed legs on either side of the lift 10. More particularly, scissor lift 10 preferably has a pair of outside legs 18 and a pair of inside legs 20 extending from the frame 12 to the deck 14. The outside legs 18 are located on the scissor lift 10 exterior to the inside legs 20. The outside and inside legs 18, 20 on each side of the lift 10 are pivotally connected together in a conventional manner about an axis 22 which is preferably shared by all four legs 18, 20. Therefore, respective rotation of the outside legs 18 and the inside legs 20 causes the height of the deck 14 to change. Preferably, a pin, bolt, or other similar pivot element 24 is received through an aperture 26 in each outside leg 18 and in a bearing (not shown) fitted within a bearing housing 28 of each inside leg 20. The bearing housing 28 can be integral to the inside leg 20 or can be connected thereto in any conventional manner, including without limitation by welding, brazing, gluing or otherwise bonding, bolting, screwing, press fitting, and the like. The pivot connection described herein and illustrated in the figures represents only one possible type of pivot connection between pairs of inside and outside legs 18, 20. One having ordinary skill in the art will appreciate that other well-known pivot connections are possible and fall within the spirit and scope of the present invention.

In the preferred embodiment of the present invention shown in the figures, the outside legs 18 are pivotally secured in a conventional fashion at one end 30 to the frame 12, and the inside legs 20 are pivotally secured in a conventional fashion at one end 32 to the deck 14. Preferably, the legs 18, 20 are secured by and are pivotal about pivot pins or other such elements 34, 36, respectively. As such, the legs 18, 20 are pivotal about pivot points coinciding with the pivot elements 34, 36. The pivot elements 34, 36 preferably pass through apertures in the legs 18, 20 and matching apertures in flanges 38, 40 on the frame 12 and deck 14, respectively. One having ordinary skill in the art will recognize that there are many conventional ways to pivotally secure the legs 18, 20 to the frame 12 and deck 14, such as by rivets, bolts, mating pins and sockets or other similar joints, and the like. In addition to the manner in which the legs 18, 20 are coupled to the frame 12 and deck 14 as just described, each of these alternative manners of coupling the legs 18, 20 to the frame 12 and deck 14 falls within the spirit and scope of the present invention.

Deck rollers 42 are preferably secured for rotation to the opposite ends 44 of the outside legs 18, and frame rollers 46 are preferably secured for rotation to the opposite ends 48 of the inside legs 20. When the legs 18, 20 are rotated about axis 22, the outside legs 18 pivot about pivot elements 34 and the inside legs 20 pivot about pivot elements 36. This motion causes the deck and frame rollers 42, 46 to translate horizontally as the distance between the deck and frame rollers 42, 46 changes (i.e., as the deck rollers 42 move vertically).

The illustrated deck 14 has a downwardly depending skirt 50 extending peripherally from the deck surface 52. The flanges 40 to which the inside legs 20 are pivotally secured preferably extend from the skirt 50 as shown in the figures. With particular reference to FIG. 4, the skirt 50 preferably defines two deck rails 54 running along the sides of the deck 14 and upon which the deck rollers 42 roll. Preferably, the deck rails 54 are sufficiently wide to support the deck 14 upon the deck rollers 42 and are sufficiently long to provide roller support in a range of lift positions from the fully lowered position shown in FIG. 5 to the fully raised position shown in FIG. 6. The length of the deck rails 54 selected is therefore dependent upon the range of positions of the legs 18, 20 and ultimately upon the range of positions in which the lift 10 can be placed.

The illustrated deck rails 54 are turned edges of the skirt 50, but can instead take many other forms well known to those skilled in the art. For example, the deck rail 54 can be the unturned edges of the skirt 50 if the skirt 50 is made of sufficiently thick members, or can be a set of elongated bars, tracks, rails, or other elements secured to or beside the skirt edges in any conventional manner (such as by welding, brazing, bolting, screwing, riveting, nailing, and the like). The shape of the deck rails 54 can be flat as shown in the figures or can have any other profile desired, including without limitation an H or L-shaped profile, a concave or convex V or U-shaped profile, and longitudinally grooved profiles. Preferably, the rollers 42 are shaped to match such alternatively shaped deck rails 54.

Although rollers 42 upon deck rails 54 are preferred, many other translation elements can instead be used to accomplish the same functions as the rollers 42 and deck rails 54. For example, the ends 44 of the outside legs 18 can be fitted with low-friction material in the form of blocks, strips, bands, and the like to slide against the deck rails 54 in the movement of the legs 18, 20. Also, the deck rails 54 can be fitted with similar low-friction material to permit the outside legs 18 to slide against the deck rails 54. The rollers 42 and deck rails 54 can instead be replaced by conventional sliding track assemblies (e.g., ball bearing tracks or glides) attached in a conventional manner to the ends 44 of the outside legs 18 and to the skirt 50 for sliding movement of the outside legs 18 with respect to the deck 14. The elements enabling translation of the ends 44 of the outside legs 18 can be in limited engagement with the skirt 50 such as the deck rollers 42 rolling upon the deck rails 54, or can be more fully engaged with the skirt 50. For example, the deck rollers 42 can be fitted between and slide along a pair of rail members or opposing surfaces of a track on the skirt 50, can fit and roll along grooves in the deck rails 54, or can have teeth or apertures which mate with apertures or teeth, respectively, in the deck rail 54. The various translation elements (rollers, slides, tracks, and the like) and the manner in which they translate along the skirt 50 as described above fall within the spirit and scope of the present invention. In addition to the manner in which the legs 18, 20 are coupled to the frame 12 and deck 14 via the rollers 46, 42 as just described, each of these alternative manners of coupling the legs 18 to the deck 14 via other translation member falls within the spirit and scope of the present invention.

It should be noted that the deck rails 54 often serve to strengthen the skirt 50 and therefore the deck 14 in addition to serving as surfaces upon or over which translation elements of the outside legs 18 move. Therefore, the shape and/or manner of connection of the deck rails 54 is preferably selected to accomplish both functions. Also, the skirt 50 need not necessarily extend about the entire periphery of the deck 14 as shown in FIGS. 4–6. Although a peripheral skirt 50 is preferred to serve as a barrier to entry of foreign matter into the lift 10 when in its fully lowered position, such a skirt is not required to practice the present invention. If desired, the skirt 50 can be replaced by walls, framework, or members which are of sufficient size and serve only to support the deck rails 54 and the pivot elements 36 in their positions disposed a distance from the underside of the deck surface 52.

The ends 48 of the inside legs 20 preferably are coupled to the frame for translation across the frame 12 in a manner similar to the ends 44 of the outside legs 18 translating across the deck 14. Specifically, the frame rollers 46 on the ends 48 of the inside legs 20 preferably roll along a frame rail 56 secured to the frame 12. The frame rails 56 are preferably elongated members having C-shaped cross-sections as shown in the figures. The frame rollers 48 therefore preferably roll between upper and lower surfaces of the frame rails 56. Although this frame rail and roller design is preferred, many other translation elements can be used to smoothly translate the ends 48 of the inside legs 48 along the frame 12. For example, the frame rail 56 can be flat such as the deck rails 54 on the deck skirt 50, can be H, V, or L-shaped, or can take the shape of any of the alternative rail types discussed above with reference to the deck rails 54 of the deck skirt 50. Also, the frame rails 56 and frame rollers 46 can be replaced by many other conventional translation elements permitting sliding or rolling movement of the inside leg ends 48 along the frame 12 as discussed above with reference to the deck rails 54 and the deck rollers 42.

For reasons that will be discussed in more detail below, the frame rails 56 are preferably elevated a distance over the base 16 of the frame 12 in a conventional manner. For example, the frame rails 56 can be located upon elevating bars 78 attached in a conventional manner to the base 16 of the frame 12, the frame rails 56 themselves can be made relatively high to elevate the surface upon which the frame rollers 46 roll, the frame 12 can be shaped to have an elevated portion or portions located beneath the frame rails 56, etc.

The above-described arrangement between the legs 18, 20, the deck 14 and the frame 12 permits smooth and steady vertical movement of the deck 14 with respect to the frame 12. With reference to FIGS. 4–6, when the inside legs 20 are pivoted about the pivot elements 24, 36 in a clockwise direction and when the outside legs 18 are pivoted about the pivot elements 24, 34 in a counter-clockwise direction, the deck rollers 42 roll along the deck rails 54 toward their positions shown in FIG. 6 and the frame rollers 46 roll along the frame rails 56 toward their positions also shown in FIG. 6. It should be noted that the legs 18, 20 pivot about pivot points coinciding with the deck and frame rollers 42, 46 as the legs 18, 20 rotate and translate. The legs 18, 20 therefore push the deck 14 upward as they rotate in this manner. When the inside legs 20 are pivoted about the pivot elements 24, 36 in a counter-clockwise direction as seen in FIGS. 4–6 and when the outside legs 18 are pivoted about the pivot elements 24, 34 in a clockwise direction, the deck rollers 42 run along the deck rails 54 back to their positions in FIG. 5 and the frame rollers 46 roll along the frame rails 56 back to their positions also shown in FIG. 5. The legs 18, 20 therefore pull the deck 14 downward and/or permit the deck 14 to fall under its own weight as the legs 18, 20 rotate in this manner.

The preferred embodiment of the present invention has a pair of connecting elements 58, 60 to increase the stability of the lift 10 and to help maintain the legs 18, 20 of each pair of outside and inside legs 18, 20 in the same rotational positions. The outside legs 18 are preferably connected to one another by connecting element 58, and the inside legs 20 are preferably connected to one another by connecting element 60. The connecting elements 58, 60 are preferably beams or bars which are connected to the legs 18, 20 in any conventional manner, such as by being welded, brazed, bolted, riveted, screwed, nailed, or glued thereto. In the preferred embodiment of the present invention, the connecting element 58 connecting the outside legs 18 together is an L-shaped beam or a pair of plates welded (or otherwise secured together in a conventional manner) in an L-shape, and is located at the upper ends 44 of the outside legs 18 when viewed in FIGS. 4 and 6. Also in the preferred embodiment of the present invention, the connecting element 60 connecting the inside legs 20 together is a hollow tube having a square cross-sectional shape, and is located just above the axis of rotation 22 of the inside legs 20 as viewed in FIGS. 4 and 6.

It will be appreciated by one having ordinary skill in the art that the connection elements 58, 60 can take virtually any hollow or solid cross-sectional shape and can be secured to their respective leg pairs 18, 20 in a number of other locations along the lengths of the legs 18, 20. For example, the connection element 58 between the outside legs 18 can instead be in a location which is on the opposite side and opposite ends of the legs 18 from the connection element location illustrated in the figures. As another example, the connection element 60 between the inside legs 20 can instead be located on the opposite side of the rotation axis 22 or further up on the inside legs 20 on the same side of the rotation axis 22. However, the locations of the connection elements 58, 60 described above and illustrated in the figures is preferred in light of the preferred location and orientation of the actuator 62 described below.

To rotate the legs 16 in the manner described above, an actuator 62 is preferably secured between the connection elements 58, 60 and can be actuated to push and pull the legs 18, 20 into different rotational positions with respect to one another. The actuator 62 is therefore indirectly secured at one end to the outside legs 18 and at another end to the inside legs 20. When the actuator 62 is actuated (e.g., extended or retracted), the connection points 64, 66 at which the actuator 62 is connected to the legs 18, 20 are forced apart or together to thereby rotate the legs 18, 20 about the pivot elements 24, 34, 36. As best understood with reference to FIG. 6, to produce torque about the axis of rotation 22 sufficient to rotate the legs 18, 20 about the axis of rotation 22, the line through which the actuator 62 exerts force should not be aligned with the axis of rotation 22, nor should that line ever cross the axis of rotation 22 because doing so would bring the legs 18, 20 into a position in which the actuator 62 cannot exert any appreciable torque between the legs 18, 20. Therefore, the actuator 62 in the preferred embodiment of the present invention shown in the figures is not aligned with respect to the axis of rotation 22 and is instead skewed with respect thereto.

Figure 3:
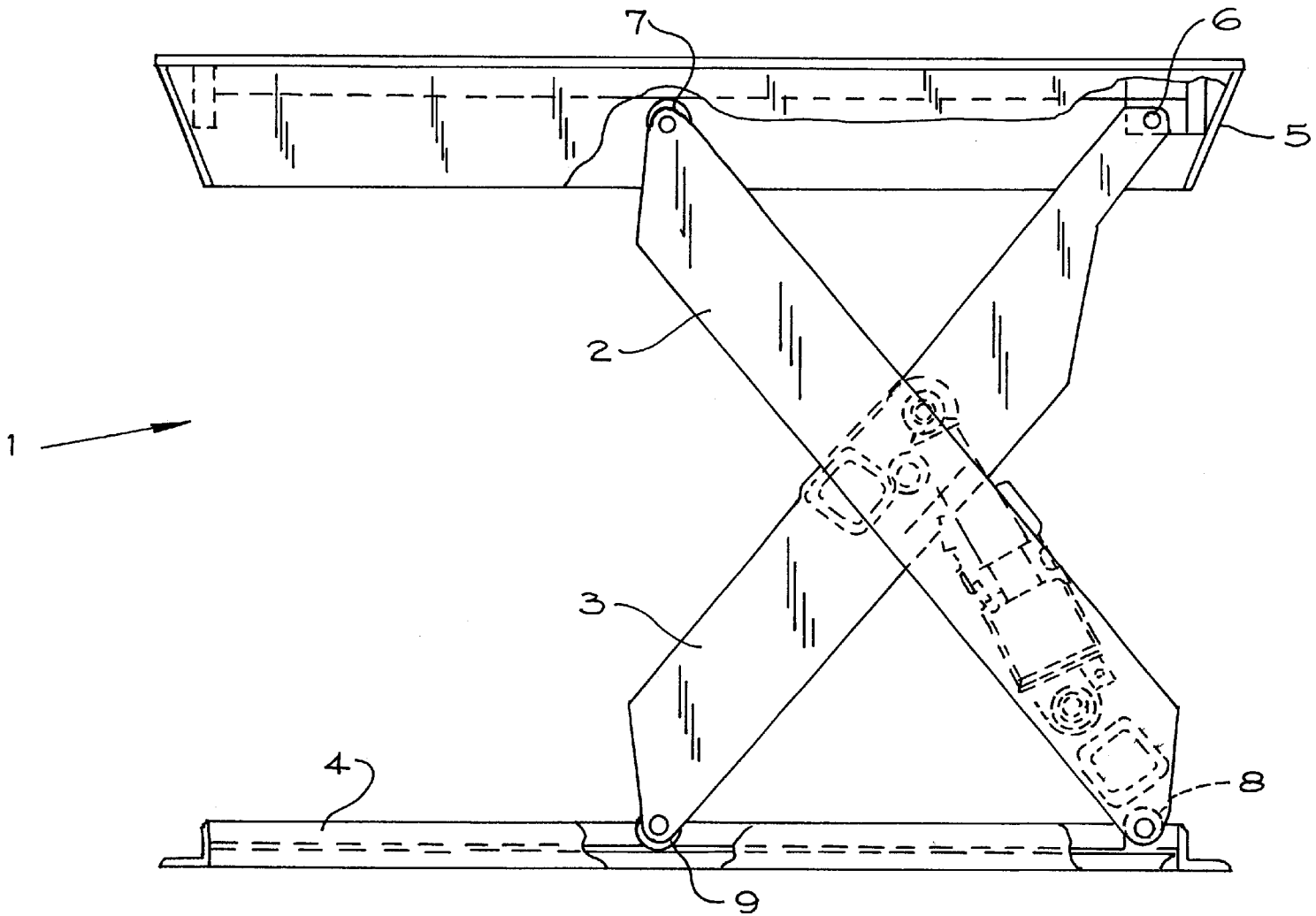
Fig. 3 (Prior Art)
FIG. 3 is a side elevational view, partly broken away, of the prior art scissor lift shown in FIGS. 1 and 2, with the lift in its fully elevated position.

The actuator 62 is preferably rotatably attached in a conventional manner (e.g., via a pivot pin, bolt, hinge, or other conventional connection element or elements) to the middle of the connecting element 58 and to the middle of the connecting element 60. Specifically, the actuator base 68 is preferably mounted for rotation via a pivot 64 on the connecting element 58, and the actuator shaft 67 is preferably mounted for rotation via a pivot 66 on the connecting element 60. More preferably, the actuator shaft 67 is mounted for rotation to a pivot bracket 70 extending or connected in a conventional fashion to a middle location of the connecting element 60. With reference to FIGS. 3 and 4, force applied by the actuator 62 against the pivot 66 creates a torque on the inside legs 20 about the pivot elements 24 to thereby change the rotational position of the legs 18, 20 and to raise or lower the deck 14. Similarly, force applied by the actuator 62 against the pivot 68 creates a torque on the outside legs 18 about the pivot elements 24 also to change the rotational position of the legs 18, 20 and to raise or lower the deck 14. Preferably, the connecting elements 58, 60 are reinforced in a conventional manner by reinforcement gussets, braces, or other such elements indicated in the figures at 71. Such reinforcement members can be integral to the connecting elements 58, 60 and/or legs 16 or connected thereto in a conventional manner such as by welding, bolting, riveting, screwing, and the like.

One having ordinary skill in the art will appreciate that the location and points of attachment of the actuator 62 can be different than that described above and illustrated in the figures. With reference to FIG. 6 for example, the actuator 62 can instead be attached to the lower ends 30 of the outside legs 18 either directly or indirectly (e.g., to a connecting member which is itself connected to the outside legs 18) and attached either directly or indirectly in a location along the length of the inside legs 20. Depending upon the manner in which the actuator 62 is connected (i.e., to connecting elements 58, 60, directly to the legs 18, 20 as described below, or otherwise), such connection can require moving the location of the connecting elements 58, 60 and/or adding one or more connecting elements 58, 60 to the lift 10. As indicated above, the actuator 62 should be positioned between the legs 18, 20 so that the axis of rotation 22 of the legs 18, 20 never crosses or becomes aligned with a line extending through the actuator's points of connection. If the axis of rotation 22 were to cross or become aligned with this line, the actuator 62 would be unable to exert torque upon the legs 18, 20.

The actuator 62 can take many forms, including without limitation a hydraulic or pneumatic piston actuator, jack-type actuators employing threaded rod, ratchet, and other conventional jacking mechanisms, and the like. Preferably however, the actuator 62 is a hydraulic piston actuator. Actuator and jacking mechanisms capable of changing and maintaining the distance between elements are well known to those skilled in the art and are therefore not discussed further herein.

The actuator 62 is powered and controlled in a conventional manner dependent upon the type of actuator employed. For example, the actuator 62 can be directly powered by electricity, by pressurized gas, fluid or air, by one or more motors, etc. In the preferred embodiment of the present invention, hydraulic fluid is pumped to and returned from the hydraulic piston actuator 62 via hydraulic lines 72 and a pump 74 driven by a motor 76 (shown only in FIG. 4) controlled by one or more user-operable controls (not shown). The pump 74 can instead be replaced by a compressor driven by the motor 76 to supply the actuator 62 with pressurized gas on demand. Such systems and their manner of connection and operation are well known to those skilled in the art.

Figure 1:
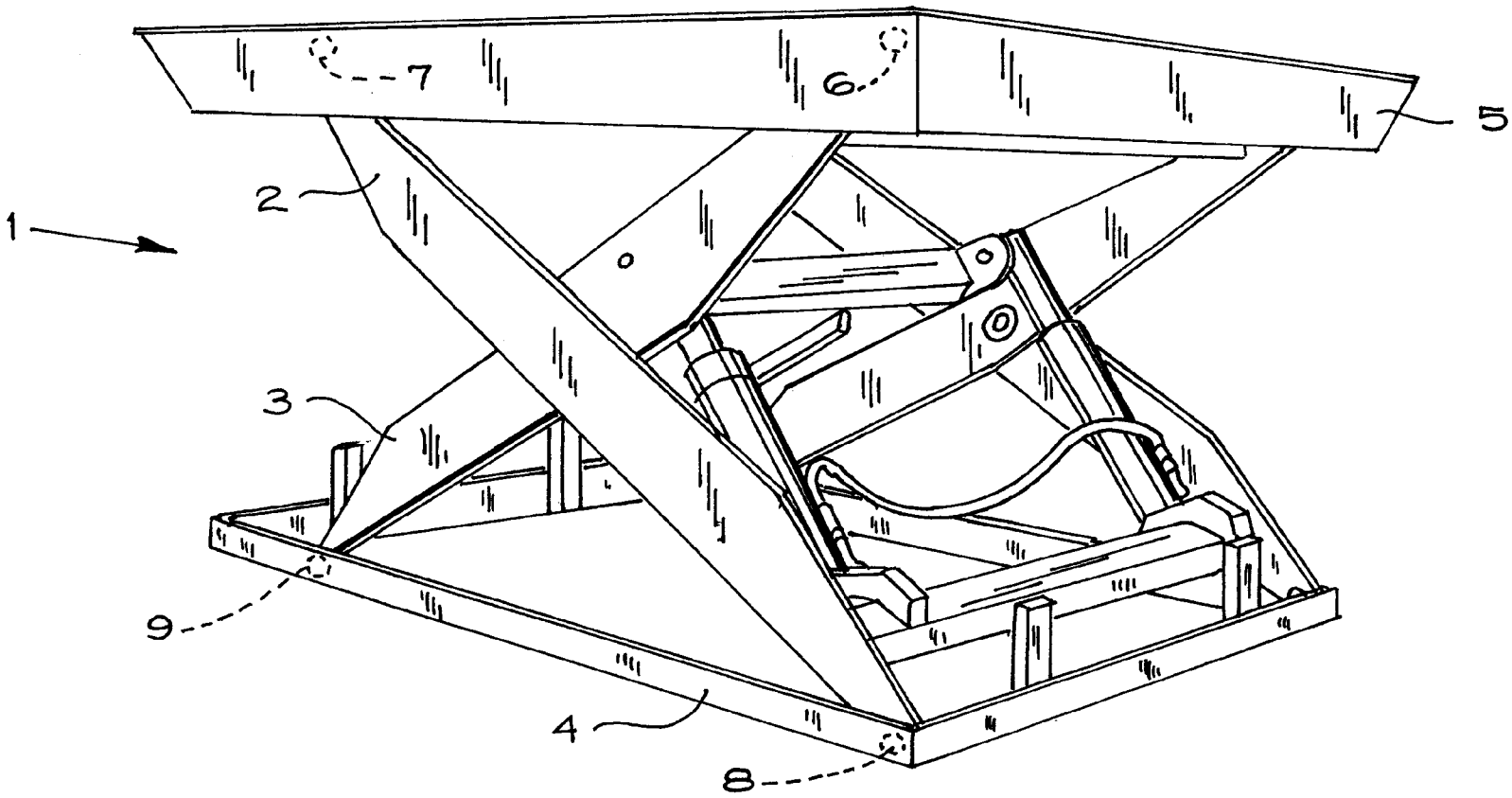
Fig. 1 (Prior Art)
FIG. 1 is a perspective view of a prior art scissor lift, showing the scissor lift in an elevated position.
Figure 2:
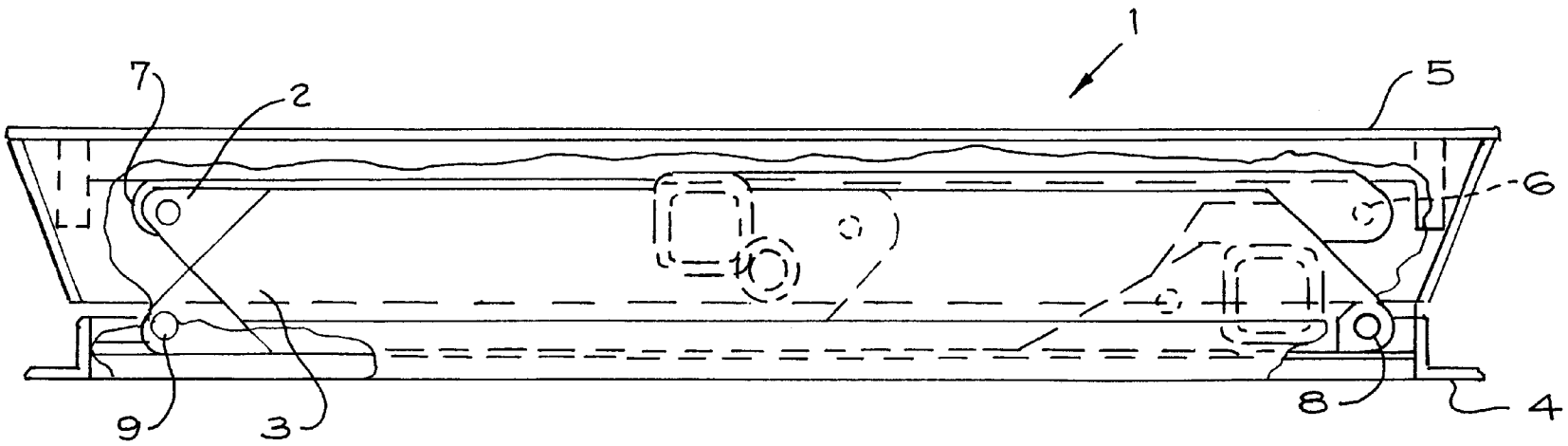
Fig. 2 (Prior Art)
FIG. 2 is a side elevational view, partly broken away, of the prior art scissor lift shown in FIG. 1, with the lift in its fully lowered position.

An important feature of the present invention is the locations of the pivot elements 34, 36, the deck rollers 42, and the frame rollers 46 with respect to the deck 14 and the frame 12. Conventional lift designs typically locate the pivot elements close to the base of the lift frame 4 and close to the surface of the deck 6, respectively, as shown in FIGS. 1–3. With particular reference to FIGS. 1 and 3, conventional lifts typically have legs mounted for pivotal movement to the deck 5 about an uppermost location of the legs, such as in the upper left-hand corner of the legs 3 in FIGS. 1 and 3. Similarly, conventional lifts typically have legs mounted for pivotal movement to the frame 4 about a lowermost location of the legs, such as in the lower left-hand corner of the legs 2 in FIGS. 1 and 3. Also with reference to FIGS. 1 and 3, conventional lifts typically have legs with translation elements (e.g., rollers and the like) located in an uppermost location of the legs, such as in the upper right-hand corner of the legs 2 in FIGS. 1 and 3. Similarly, conventional lifts typically have legs with translation elements located in a lowermost location of the legs, such as in the lower right-hand corner of the legs 3 in FIGS. 1 and 3.

In contrast, the illustrated deck pivot elements 36 are located a distance from the deck surface 52, and the frame pivot elements 34 are located a distance from the base 16 of the frame 12. This change permits the inside legs 20 to be pivotally secured to the deck 14 about a lower position on the inside legs 20, such as in upper left-hand corner of the inside legs 20 illustrated in FIG. 6, and permits the outside legs 18 to be pivotally secured to the frame 12 about a higher position on the outside legs 18, such as in the lower left-hand corner of the outside legs 18 illustrated in FIG. 6. Also, this change permits the inside legs 20 to translate via deck rollers 46 located at a higher position on the inside legs 20, such as in the lower right-hand corner of the inside legs 20 illustrated in FIG. 6, and permits the outside legs 18 to translate via frame rollers 42 located at a lower position on the outside legs 18, such as in the upper right-hand corner of the outside legs 18 illustrated in FIG. 6. Preferably, the frame pivot elements 34 and the frame rollers 46 are therefore located in a higher position with respect to the base 16 of the frame 12, and the deck pivot elements 36 and the deck rollers 42 are therefore located in a lower position with respect to the deck surface 52. As discussed in more detail above, the deck rollers 42 preferably roll along the deck rails 54 of the skirt 50 (located a distance from the underside of the deck surface 52). Similarly, the frame rollers 46 preferably roll along the frame rails 56 (located a distance from the base 16 of the frame 12).

In the preferred embodiment of the present invention, the deck pivot elements 36 and the deck rollers 42 are located in the same horizontal plane 80 throughout the range of positions of the legs 18, 20, and the frame pivot elements 34 and the frame rollers 46 are located in the same horizontal plane 82 throughout the range of positions of the legs 18, 20. These relationships help to ensure that the deck 14 remains horizontal and level in all positions of the lift 10.

With reference to FIGS. 1–3, it should be noted that conventional lifts 1 have deck pivots 6 and deck rollers 7 which remain above the frame pivots 8 and the frame rollers 9 throughout the range of movement of the lift 1. The deck pivots 6 and the deck rollers 7 are typically co-planar in such lifts 1, as are the frame pivots 8 and the frame rollers 9. In contrast, it should be noted that when the lift 10 of the present invention is lowered to the position shown in FIG. 5, the deck pivot elements 36 and/or the deck rollers 42 drop below the elevation of the frame pivot elements 34 and/or the frame rollers 46. Most preferably, the deck pivot elements 36 lie in the same horizontal plane 80 as the deck rollers 42 and the frame pivot elements 34 lie in the same horizontal plane 82 as the frame rollers 46. When the lift 10 is lowered to the position shown in FIG. 5, the horizontal plane 80 is lowered beneath the horizontal plane 82. This relationship is facilitated at least in part by the locations of the pivot elements 34, 36, the deck rollers 42, and the frame rollers 46 as described above. Specifically, by virtue of the locations of the pivot elements 34 and the deck rollers 42 on the outside legs 18, the outside legs 18 fit between the frame 12 and the deck 14 behind the skirt 50 when the lift 10 is in its fully lowered position. Also, by virtue of the locations of the pivot elements 36 and the frame rollers 46 on the inside legs 20, the inside legs 20 also fit between the frame 12 and the deck 14 behind the skirt 50 when the lift 10 is in its fully lowered position.

The locations of the pivot elements 34, 36, the deck rollers 42, and the frame rollers 46 with respect to the deck 14 and the frame 12 as just described offers a number of advantages over prior art lifts. Due to the roller and pivot locations disposed from the underside of the deck surface 52 and from the base 16 of the frame 12 as discussed above, an amount of roller travel along the deck rails 54 and the frame rails 56 in the present invention produces a larger amount of vertical deck travel than the same amount of horizontal roller travel in prior art lifts. Therefore, the lift 10 of the present invention is capable of increased vertical movement for the same horizontal movement of the legs when compared to prior art lifts. Depending upon the vertical location of the deck pivot elements 36 and the deck rollers 42 with respect to the underside of the deck surface 52, and depending upon the vertical location of the frame pivot elements 34 and the frame rollers 46 with respect to the base of the frame 12, the increase in vertical travel can be 10–25% over that of prior art lifts. In other words, the distance between the horizontal plane 80 and the underside of the deck surface 52 determines where the deck pivot elements 36 and/or the deck rollers 42 are located and the amount of additional vertical travel produced by horizontal movement of the deck rollers 42 on the deck rails 54. Likewise, the distance between the horizontal plane 82 and the base 16 of the frame 12 determines where the frame pivot elements 34 and/or the frame rollers 46 are located and the amount of additional vertical travel produced by horizontal movement of the frame rollers 46 on the frame rails 56.

It should be noted that the increase in lift range resulting from the above-described arrangement is not limited to movement in the vertical direction, but includes applications in which the lift 10 moves upward and forward or backward, and applications in which the lift moves upward while tilting forward or backward. For example, changing the location of the bearing housing 28, the pivot element 24, the aperture 26, and the axis of rotation 22 of the legs 18, 20 to a location upward or downward on the legs 18, 20 as viewed in FIGS. 5 and 6 will cause the deck 14 to move forward or rearward as the deck 14 is raised or lowered. Likewise, moving the location of these elements to the left or right on the legs 18, 20 as viewed in FIGS. 5 and 6 will cause the deck 14 to tilt forward or backward as the deck 14 is raised or lowered. The teachings of the present invention apply equally to alternative lift types such as these.

The above-described locations of the pivot elements 34, 36, the deck rollers 42 on the outside legs 18 and deck rails 54, and the frame rollers 46 on the inside legs 20 and inwardly-disposed frame rails 56 results in a lift design having less interference between legs 18, 20 as the lift 10 is raised and lowered. As a result, tapered or shaped legs such as those found in prior art lifts are no longer needed, thereby permitting wider, larger, and stronger legs 18, 20 to be used (see FIGS. 4–6). This provides for a stronger and more stable lift 10 and reduces manufacturing costs of the legs 18, 20. Also, because the legs 18, 20 of the lift 10 are in less extended positions for each lift height, the legs 18, 20 of the present invention provide a wider support and a more stable lift 10 for comparable lift heights. The lift 10 of the present invention can also lift higher than prior art lifts having comparable leg lengths.

The lift 10 preferably has a safety latch 84 and a latching pin 86 (see FIG. 4) that cooperate to latch the lift 10 in an elevated position in manner well known to those skilled in the art. For example, the safety latch 84 of the preferred embodiment is an arm pivotally secured in a conventional manner to one of the inside legs 20. The safety latch 84 has a hooked end, and can be pivoted on the inside leg 20 to latch with a pin 86 on an outside leg 18 corresponding to the inside leg 20. When latched, the safety latch 84 preferably prevents the legs 18, 20 from movement with respect to one another, thereby preventing the lift 10 from unexpected lowering. One having ordinary skill in the art will recognize that a number of other conventional safety latch designs can be used to accomplish the same function, including without limitation a safety bar positioned between a leg and the frame to be compressed therebetween in the event of unexpected lift drop, a latch connected between the deck or frame and a leg when the lift is in an elevated position, one or more stops releasably secured to one or more of the deck rails 54 and/or the frame rails 56 adjacent the rollers 42, 46 when the lift 10 is elevated, etc. Also, the safety latch 84 can be made adjustable, for example, by a number of pins 86 located to latch with the safety latch 84 at different lift heights. Other such adjustment mechanisms are well known to those skilled in the art and are therefore not discussed further herein.

The present invention can be provided with a shroud 88 (shown only in FIG. 4) attached in a conventional manner to at least part of the periphery of the deck 14 and the frame 12. The shroud 88 preferably has bellow-type folds therein to collapse into a relatively small size when the lift 10 is lowered. The bellow-type folds preferably unfold when the lift 10 is raised to obstruct access to the area between the frame 12 and the deck 14 regardless of the lift position. The shroud 88 can be made from any number of materials found in sheet form, such as rubber, plastic, nylon and other synthetics, fabric, foil and paper. Most preferably, the shroud 88 is made from folded vinyl sheeting or can also be a roller curtain.

The frame 12, deck 14, legs 18, 20, connecting elements 58, 60, and the safety latch and pin 84, 86 can each be made of any number of materials capable of bearing load without significant deflection, including without limitation metal, plastics and other synthetics, wood, composites, and refractory materials. Preferably however, these elements are made from a strong rigid material such as steel, iron, or aluminum. Most preferably, these elements are all made of steel.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, the lift 10 of the present invention described above and illustrated in the drawings preferably has four legs, two outside legs 18 and two inside legs 20. Many different lift applications and lifting devices can employ the principles of the present invention while having fewer or more legs than the preferred embodiment lift 10. For example, one outside leg 18 and one inside leg 20 can be substantially centered beneath the deck 14 and operate in a similar manner to the legs 18, 20 of the preferred embodiment lift 10. In such a case, the deck rail 54 can be a beam, wall, or other such element running down the center of the deck's underside, and the deck 14 would preferably have additional support along one or more of its ends or sides to lessen the chance of lift tipping or bowing.

In another embodiment, the deck 14 is supported by only one outside leg 18 and one inside leg 20 located on one side of the deck 14 much in the same way as one outside and inside leg pair appears in FIGS. 4–6. The opposite side of the deck 14 would preferably be supported for vertical travel in any conventional manner. In yet another embodiment, legs in addition to those shown in FIGS. 4–6 can be employed, such as an additional inside leg or legs 20 located between the inside legs 20 shown, an additional outside leg or legs located on either side of the outside legs 18 shown (with additional deck rails 54 and frame rails 56 as necessary), and the like. It is even possible to stack legs 18, 20 atop one another for an extended scissor-like device. For example, the tops of the outside and inside legs 18, 20 illustrated in FIGS. 4–6 can instead be attached to the bottoms of additional outside and inside legs which themselves have top ends coupled to the deck 14 as shown in FIGS. 4–6. Of course, the connecting elements 58, 60 in many of these alternative embodiments might need to be moved to accommodate full lowering and raising of the lift 10 as shown in the figures. In other such embodiments such as the stacked legs just described, additional connecting elements are preferably employed between the legs 18, 20.

Where alternative embodiments of the present invention do not have connecting elements 58, 60, the actuator 62 of the present invention can be connected directly to and between outside and inside leg pairs 18, 20. Specifically, the ends of the actuator 62 can be rotatably connected to an outside leg 18 and an inside leg 20 in any conventional fashion. If desired, multiple actuators 62 can even be used for the same pair of outside and inside legs 18, 20, such as an actuator rotatably connected substantially horizontally and below the axis of rotation 22 to an outside leg 18 and an inside leg 20 and an actuator rotatably connected substantially horizontally and above the axis of rotation 22 to the outside leg 18 and inside leg 20. Alternatively, an actuator 62 can be rotatably connected substantially vertically and left of the axis of rotation 22 (with reference to the views of FIGS. 5 and 6) to an outside leg 18 and an inside leg 20 and an actuator 62 can be connected substantially vertically and right of the axis of rotation 22 to the outside leg 18 and to the inside leg 20. The particular connection locations for the actuator(s) used should be selected to permit the legs 18, 20 to rotate from a fully lifted position to a fully retracted position.

The legs 18, 20 in the preferred embodiment lift of the present invention can also be reversed as desired. For example, it is possible to have a lift of the same general construction shown in FIGS. 4–6, but with the legs 18, 20 and associated elements substantially upside down so that the inside legs 20 ride upon frame rails 56 or other such elements on the underside of the deck 14 and the outside legs 18 ride upon rail surfaces or other such elements on the sides of the frame 12.

In the preferred embodiment of the present invention, the legs 18, 20 are secured for pivotal rotation at one end of the frame 12 and deck 14 and for translation toward and away from an opposite end of the frame 12 and deck 14. One having ordinary skill in the art will appreciate that the legs 18, 20 need not necessarily be secured for pivotal rotation in any particular location between the ends of the frame 12 and deck 14 (e.g., at one end of the frame 12 and deck 14 as shown in the figures) to achieve the advantages of the present invention. As long as the legs 18, 20 have sufficient deck and frame length to translate in their pivoting movements, the legs 18, 20 can be located virtually anywhere between a frame 12 and a deck 14 having any desired shape, length, and width. However, it may be necessary in certain cases to provide additional support to other portions of the deck 14 in a conventional manner, such as by one or more vertical guide posts passing through the deck 14, a conventional cable and counterweight system providing a lifting force at the distal ends, corners, or edges of the deck 14, and the like.

It is even possible to use the scissor lift of the present invention only as a lifting force and to employ other well-known elements and devices to provide the necessary support to the deck 14 against tipping or bowing. Such well-known elements and devices include without limitation those just mentioned for providing additional support to the deck 14. In such cases, the legs 18, 20 need not necessarily be pivotally attached to the frame 12 and the deck 14 as described above and illustrated in the figures. Instead, both ends of the legs 18, 20 can be provided with rollers to roll and translate upon the frame 12 and beneath the deck 14 in the same manner described above with respect to the deck rollers 42 and the frame rollers 46. The location of the legs 18, 20 between the frame 12 and deck 14 in such alternative embodiments can be controlled in a number of other manners, including without limitation roller stops on the deck rails 54 and/or the frame rails 56, restraining the pivot element 24 in a conventional manner to only move in a vertical direction, securing the legs 18, 20 to the frame or to the deck via only one or two pivots, etc.

The legs 18, 20 of the present invention need not necessarily be flat or plate shaped as shown in the preferred embodiment of FIGS. 4–6. Instead, the legs 18, 20 can have a round, square, rectangular, or other cross-sectional shape and can be solid or tubular as desired. Additionally, the outside legs 18 and the inside legs 20 need not necessarily be rotatably secured to one another about their midpoints as illustrated in FIGS. 4–6. Although such connection is preferred, the axis of rotation 22 can be moved to a location down or up the lengths of the legs 18, 20, but preferably is located the same length from each bottom end 30, 48 of the legs 18, 20.

What is claimed is:

1. A scissor lift comprising:

a frame;

a deck movable relative to the frame between a fully elevated position and a fully lowered position; and a leg coupled to the frame for pivotal movement about a first pivot point and coupled to the deck for pivotal movement about a second pivot point, the leg rotatable between a first position in which the first pivot point is higher than the second pivot point and a second position in which the first pivot point is lower than the second pivot point, the first position corresponding to the fully lowered position of the deck and the second position corresponding to the fully elevated position of the deck.

2. The scissor lift as claimed in claim 1, wherein the leg is coupled to the frame for purely pivotal movement about the first pivot point.

3. The scissor lift as claimed in claim 2, further comprising a translation element coupled to the leg to facilitate pivotal and translation movement of the leg relative to the deck.

4. The scissor lift as claimed in claim 3, wherein the translation element is a roller.

5. The scissor lift as claimed in claim 1, wherein the leg is coupled to the deck for purely pivotal movement about the second pivot point.

6. The scissor lift as claimed in claim 5, further comprising a translation element coupled to the leg to facilitate pivotal and translation movement of the leg relative to the frame.

7. The scissor lift as claimed in claim 6, wherein the translation element is a roller.

8. The scissor lift as claimed in claim 3, further comprising a second leg coupled to the deck for pivotal movement about a third pivot point and coupled to the frame for pivotal movement about a fourth pivot point, the second leg rotatable between a first position in which the third pivot point is lower than the fourth pivot point and a second position in which the third pivot point is higher than the fourth pivot point, the first position corresponding to the fully lowered position of the deck and the second position corresponding to the filly elevated position of the deck.

9. A scissor lift comprising:

a frame;

a deck movable relative to the frame between a fully elevated position and a fully lowered position;

a first leg supporting the deck on the frame, the first leg being coupled to the frame for pivotal movement about a first pivot point;

a second leg supporting the deck on the frame, the second leg being coupled to the deck for pivotal movement about a second pivot point, wherein the first and second legs are pivotable between a first position in which the first pivot point is higher than the second pivot point and a second position in which the first pivot point is lower than the second pivot point.

10. The scissor lift as claimed in claim 9, wherein the first leg is coupled to the frame for pivotal and translational movement and the second leg is coupled to the deck for pivotal and translational movement.

11. The scissor lift as claimed in claim 9, wherein the first and second legs are coupled to each other for pivotal movement relative to each other.

12. The scissor lift as claimed in claim 9, wherein the first leg is coupled to the deck for purely pivotal movement about a third pivot point, and wherein the second leg is coupled to the frame for purely pivotal movement about a fourth pivot point.

13. The scissor lift as claimed in claim 12, wherein in the first position the third pivot point is lower than the fourth pivot point and in the second position the third pivot point is higher than the fourth pivot point.

14. The scissor lift as claimed in claim 9, wherein the frame includes a base and a frame rail spaced from the base, and wherein the lift further comprises a first translation element coupled to the first leg and positioned on the frame rail.

15. The scissor lift as claimed in claim 9, wherein the deck includes a deck surface and a deck rail spaced from the deck surface, wherein the lift further comprises a second translation element coupled to the second leg and positioned on the deck rail.

* * * * *

UNITED STATES PATENT AND TRADEMARK OFFICE

CERTIFICATE OF CORRECTION

PATENT NO. : 6,257,372 B1
DATED : July 10, 2001
INVENTOR(S) : Michael Schirmer

It is certified that error appears in the above-identified patent and that said Letters Patent is hereby corrected as shown below:

Column 14, claim 8,
Line 13, delete "filly" and insert -- fully --.

Signed and Sealed this

Twelfth Day of March, 2002

*Attest:*

*Attesting Officer*

JAMES E. ROGAN
*Director of the United States Patent and Trademark Office*